United States Patent [19]

Shadid et al.

[11] 4,128,070

[45] Dec. 5, 1978

[54] SHIP TANKS WITH CONTINUOUS SUPPORT SYSTEM

[75] Inventors: Fahim E. Shadid, Downers Grove; Paul R. Johnson, Oak Lawn, both of Ill.

[73] Assignee: Chicago Bridge & Iron Company, Oak Brook, Ill.

[21] Appl. No.: 825,281

[22] Filed: Aug. 17, 1977

[51] Int. Cl.[2] ..... B63B 25/08

[52] U.S. Cl. ..... 114/74 A; 220/901

[58] Field of Search ..... 114/74 R, 74 A, 74 T; 220/9 R, 9 A, 9 LG, 15, 18; 62/55, 240; 248/DIG. 1

[56] References Cited

U.S. PATENT DOCUMENTS

| | | | |
|---|---|---|---|
| 3,583,352 | 6/1971 | Alleume | 114/74 A |
| 3,908,574 | 9/1975 | Miller et al. | 114/74 R |

*Primary Examiner*—Trygve M. Blix
*Assistant Examiner*—Jesus D. Sotelo
*Attorney, Agent, or Firm*—Merriam, Marshall & Bicknell

[57] ABSTRACT

A tank with a circular horizontal cross-section, which expands and contracts in service, a tank support element on the tank and above the tank bottom extending horizontally around the tank and having a flat horizontal surface, a support base on which the tank support element flat horizontal surface rests in radial slidable contact, a horizontal collar member having a vertical or sloped circular face, a horizontal ring member having a vertical or sloped circular face, either the collar member or the ring member is joined to the tank and the other of the collar member or the ring member is joined to the support base, and the collar member vertical or sloped face is located around the ring vertical or sloped face, and restraining apparatus which prevents lateral movement of the tank when empty and at nonservice temperature. Desirably, at least the collar member circular face or the ring member circular face is insulated, and the faces are parallel to each other and matching for effecting surface-to-surface contact upon cooling of the tank, and at least the horizontal surface on the tank support element or the support base is insulated.

24 Claims, 9 Drawing Figures

FIG. 1
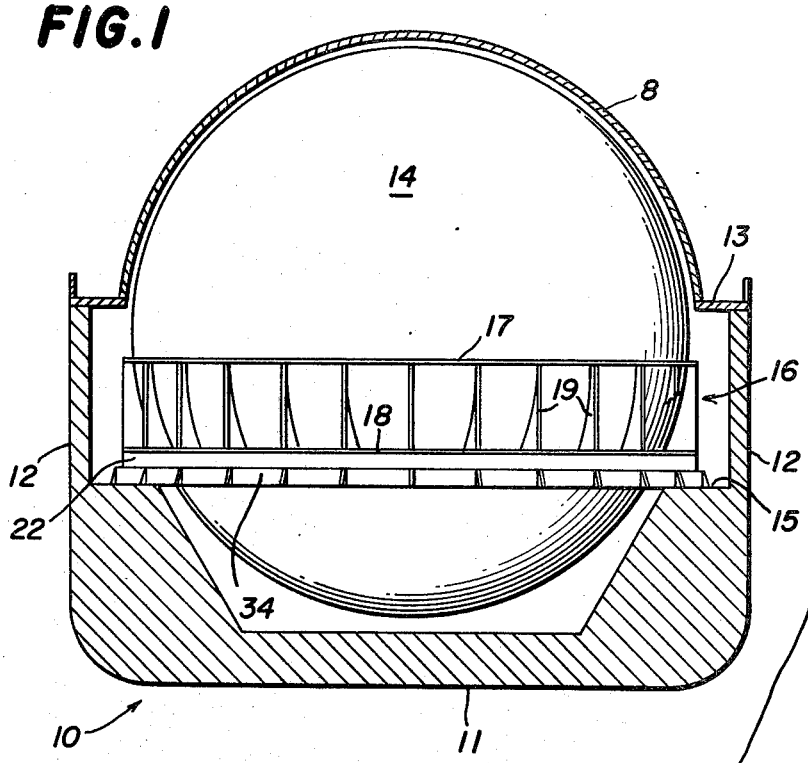
FIG. 4
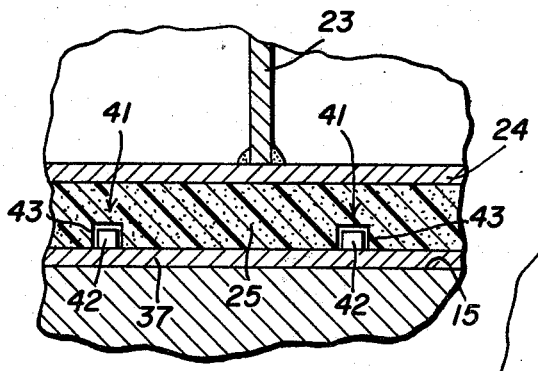
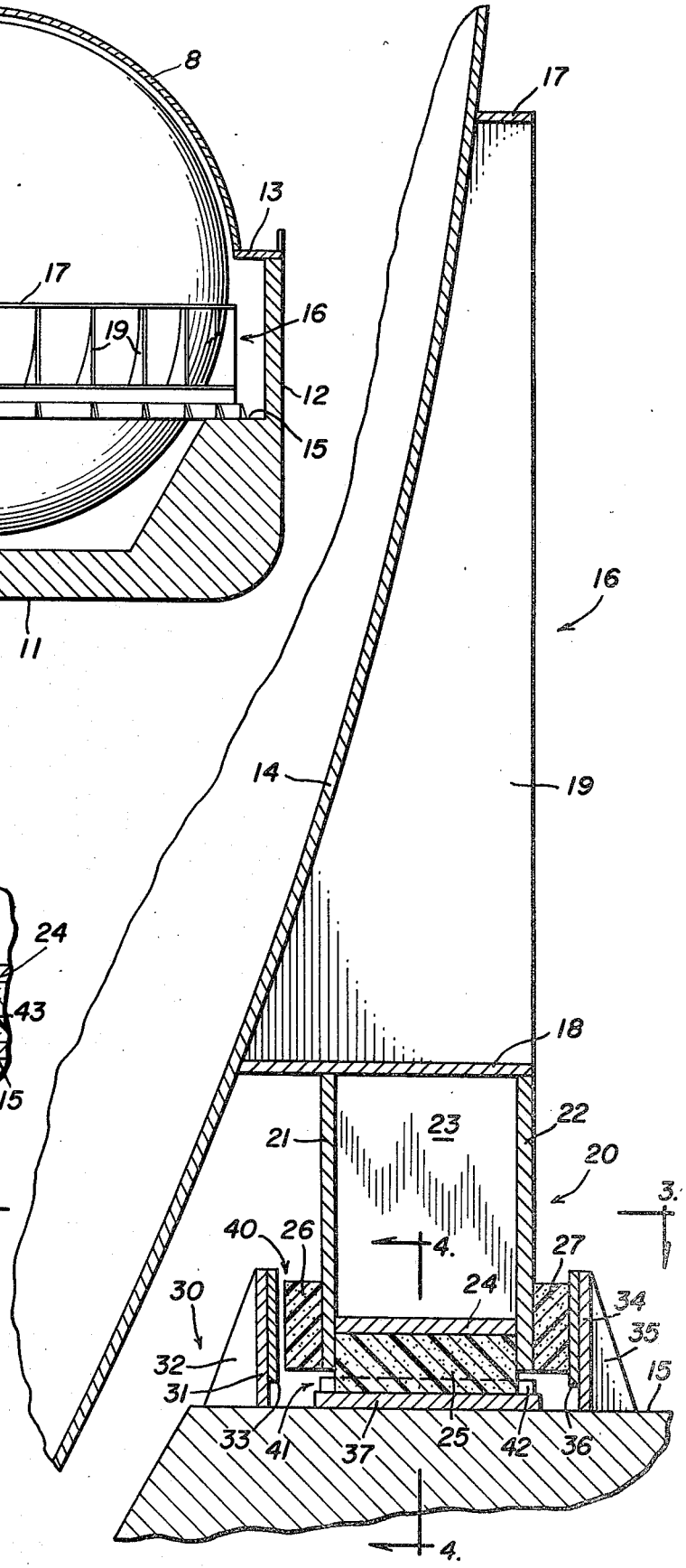
FIG. 2

(AMBIENT)

(CONTRACTED)

SHIP TANKS WITH CONTINUOUS SUPPORT SYSTEM

This invention relates to systems and structures for supporting tanks and similar type objects. More particularly, this invention is concerned with a support system for tanks and the like, and especially those which expand and contract in use, such as tanks used to store cryogenic liquids.

Tanks of metal expand and contract when subjected to a temperature cycle from ambient temperature, or above, down to a cryogenic temperature and back to ambient temperature or above. Substantial expansion is also involved when tanks are tested by subjecting them to internal pressures, especially pressures higher than design pressures. It is not a difficult problem to provide adequate support systems and structure for relatively small size tanks which go through expansion and contraction cycles since the dimensional change is quite small and can be easily accommodated by rather simple engineering structures and dimensional accommodation during the fabrication and installation thereof. In addition, the stresses created in small size tanks do not involve a serious problem.

In more recent years, tank for the storage and transportation of materials such as cryogenic liquids, are often extremely large. Not only are the overall dimensions of many of the tanks built today quite large, such as over 100 feet or more in major dimension, but the total weight of such objects has increased substantially, particularly due to the increased shell thicknesses and auxiliary equipment which must be utilized therewith. The expansion and contraction of such large size metal tanks because of the wide temperature cycles throuh which they pass in use, makes it necessary that supporting systems and structures for such tanks be able to accommodate the resulting dimensional changes without inducing, or being subjected to, unnecessary stresses which could lead to failure or distortion of the tank or supporting structure.

The prior art shows a number of support systems intended for tanks which are subjected to wide temperature cycles, as see for example the patents of Miller et al. U.S. Pat. No. 3,908,574, Johnson et al., U.S. Pat. No. 3,859,805, Sikora et al., U.S. Pat. No. 3,792,795 and Bognaes et al., U.S. Pat. No. 3,680,323. Miller et al., U.S. Pat. No. 3,908,574 discloses a spherical tank supported in a ship by a series of key-keyway supports. Johnson et al. shows a skirt stabilized tank which has a flat bottom in contact with a ship hold bottom. Sikora et al. U.S. Pat. No. 3,792,795 shows a spherical tank supported by a series of A-frame supports around the periphery of the tank. Bognaes et al., U.S. Pat. No. 3,680,323 discloses a ship having a spherical tank supported by a cylindrical skirt or shell which joins the tank at its equator. While these tank support systems are useful they are generally costly and involve fabrication difficulties which it is desired to avoid. Specifically, the Bognaes et al. skirt support is by necessity a heat conductor needed to provide the temperature gradient between the cold tank and ambient ship hull essential to its performance. Besides failing to provide a fully insulated support system for minimizing boil-off of liquefied gas, the skirt support localizes stresses in the hull and this limits its use to small and medium size tanks. The support reaction for a skirt supported spherical tank will increase as the third power of its diameter, thus spherical ship tanks larger than those in current use would require substantially greater support area, thereby limiting use of such a system.

Studies have indicated, however, that the most effective way to reduce liquefied natural gas transportation cost is to increase the ship capacity thus requiring new support systems. The next important factor in reducing transportation cost is reduction of boil-off which makes skirt support systems unsuitable because they are not fully insulated.

There is provided according to the subject invention a novel support system to be used in combination with a metal tank or the like which will accommodate the dimensional expansion and contraction that takes place in the tank because of a temperature cycle to which the tank may be subjected. The system is particularly useful for the support of very large tanks and the like. The system utilizes, in combination, a tank with a circular horizontal cross-section, which expands and contracts in service, a tank support element on the tank and above the tank bottom extending horizontally around the tank and having a flat horizontal surface, a support base on which the tank support element flat horizontal surface rests in radial slidable contact, a horizontal collar member having a vertical or sloped circular face, a horizontal ring member having a vertical or sloped circular face, either the collar member or the ring member is joined to the tank and the other of the collar member or the ring member is joined to the support base, and the collar member vertical or sloped face is located around the ring vertical or sloped face, and restraining means which prevents lateral movement of the tank when empty and at nonservice temperature. If desired, the collar member or the ring member may include the flat horizontal surface on the tank support element or on the support base. Furthermore, it is desirable that at least the collar member vertical or sloped circular face or the ring member vertical or sloped circular face be insulated, that the faces are parallel to each other and matching for effecting surface-to-surface contact upon cooling of the tank, and to insulate at least the horizontal surface on the support base or the tank support element.

In a more detailed description, a system according to the invention employs a ring member having a pair of equally spaced apart vertical or sloped circular faces with a flat horizontal surface therebetween, and a trough member having a trough with a flat horizontal surface between a pair of equally spaced apart vertical or sloped circular faces. The ring member is joined to the tank support element or to the support base and the trough member is joined to the other of the tank support element or the support base. Either way the ring member is located in the trough member with the ring flat horizontal surface in radial slidable contact with the trough flat horizontal surface. At an ambient temperature of about 10° to 35° C. one of the ring faces is close to or in contact with one of the trough faces, and at a substantially lower operating temperature the ring other face contacts the trough other face. Such a tank support system is highly useful in a ship since it prevents a so-supported tank from any lateral movement, whether the tank is at ambient temperature or at a much lower operating temperature. The contact between the trough face and the ring face, regardless of which face is radially inward, restrains the tank against unwanted horizontal slipping. It is to be understood, however, that most present applications of the invention will be for a tank temperature cycle from ambient temperature to a much lower temperature which causes contraction of the tank. The invention could be used, however, for a temperature cycle in which the tank goes from ambient temperature to a much higher temperature, causing expansion of the tank. The invention can be employed, also, in supporting a tank cycles from a temperature substantially above ambient temperature to substantially below ambient temperature and back to substantially above ambient temperature. The invention, in addition, may be used to support a tank at ambient temperature or at some other constant temperature.

In a more specific description of the invention, there is provided a combination of a tank with a circular horizontal cross-section, which expands and contracts in service, a tank support element joined horizontally to the tank, the tank support element having a pair of equally spaced apart vertical and circular faces with one face radially inward from the other face and positioned uniformly from the tank and having a flat horizontal slidable surface therebetween, a support base adapted to receive the tank support element, the support base having a flat horizontal surface in contact with the tank support element flat horizontal surface, the support base having a pair of equally spaced apart vertical and circular faces constituting a radially inward face and a radially outward face, and the pair of faces of the support base being between the pair of faces of the tank support element, or the pair of faces of the tank support element being between the pair of faces of the support base and so positioned to have each tank support element face adjacent a support base face. Clearance is provided by having the distance between the tank support element faces different than the distance between the support base faces. This difference must be enough to permit the predetermined temperature induced expansion and contraction of the tank to take place and thereby move adjoining support base and support element faces into contact with each other.

When the tank is on a ship and it is necessary or desirable to maintain the ship hold at a temperature different than the tank, heat flow may be retarded by making at least one of the adjacent tank support element and support base faces of thermal insulation. For the same reason, at least the tank support element flat horizontal surface or the support base flat horizontal surface may be made of thermal insulation. As a practical matter, insulation as described will almost always be used. Unless at least one of the mating faces of the tank support element and support base is insulated the desired shrink-fit could not take place because both faces would shrink by cooling or expand by heating, instead of having one such face substantially stationary.

In those cases where the tank is to be used to store or transport a product at a temperature substantially below, or even above, ambient temperature the tank can be insulated externally. Such insulation is not included in the drawings for clarity of illustration. For ship transport it is also feasible to insulate the ship hold and to leave the tank uninsulated.

The support system of this invention is particularly suitable for large size tanks since the load of the tank and its contents are brought directly to the bottom of the ship's hull and hence to its ultimate support which is the upward external pressure of the water beneath the hull. In addition, boil-off is minimized by a fully insulated support system used as described herein.

The invention will be described further in conjunction with the attached drawings, in which:

FIG. 1 is an elevational view partially in section of a spherical tank mounted in a ship and supported by a support system provided by the invention;

FIG. 2 is a vertical sectional view through the tank of FIG. 1 and the support system for the tank;

FIG. 4 is a vertical sectional view taken along the line 4—4 of FIG. 2;

So far as is practical the same parts or elements which appear in the different views of the drawings will be identified by the same numbers.

Figure 3:
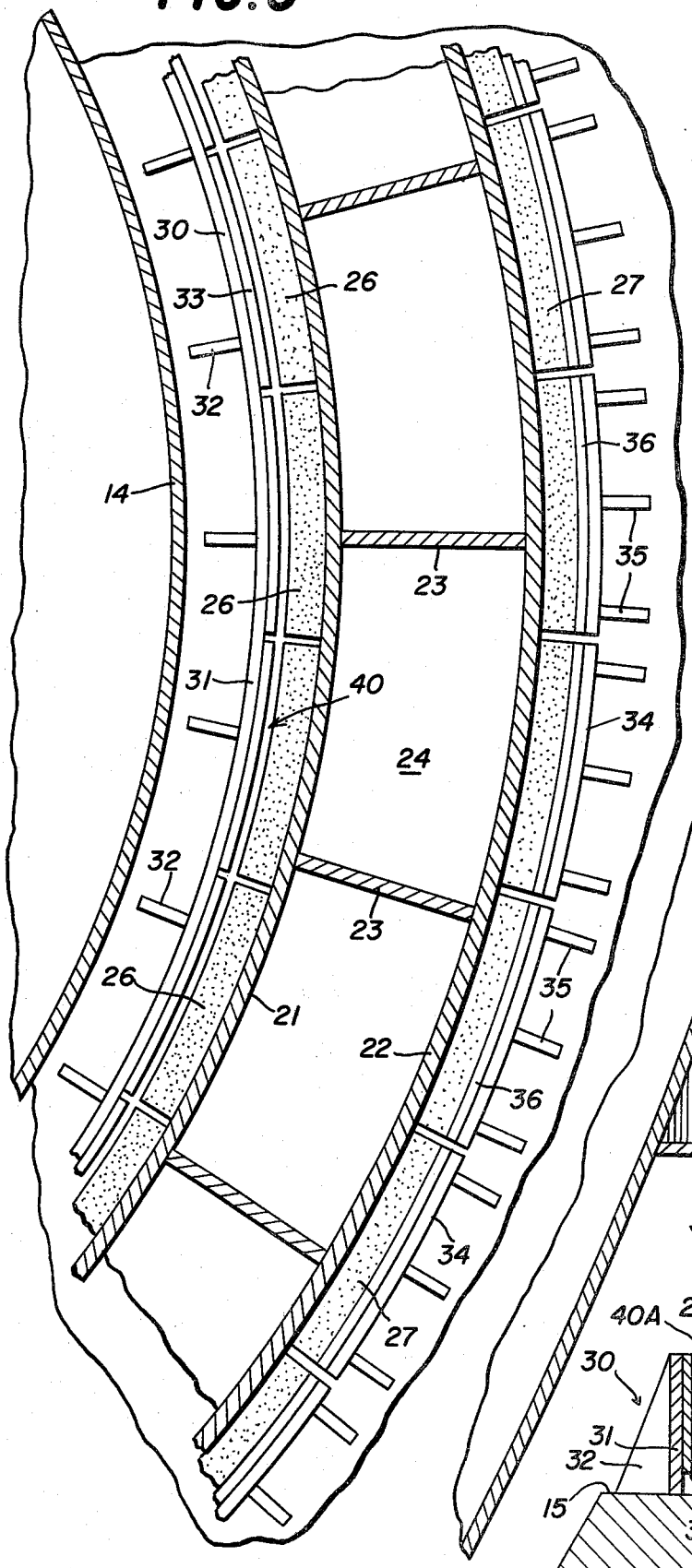
FIG. 3 is a horizontal sectional view taken along the line 3—3 of FIG. 2.

The ship 10 shown in FIG. 1 has a bottom 11, sides 12 and deck 13. Tank 14 of metal is a spherical shell and fits partially in the ship hold and partially above the deck 13. Weather cover 8 covers that part of the tank above the deck 13.

Built integrally into the ship hold is support base 15 which constitutes a horizontal surface. A tank support element 16 extends horizontally around the tank and is joined to the external surface of the tank. The tank support element 16 as shown in FIGS. 1 to 4 constitutes an upper horizontal girder 17 and a lower horizontal girder 18 with a series of vertically positioned, equally spaced apart radial directed stiffener plates 19 extending from the upper girder 17 to the lower girder 18.

The tank support system embodiment illustrated by FIGS. 1 to 4 has a ring member 20 joined to the tank support element 16, and a trough member 30 located on support base 15. The lower part of ring member 20 is positioned in the trough member 30.

Ring member 20 includes a pair of vertical equally spaced apart cylindrical members 21 and 22 which are joined at their upper ends to the lower surface of girder 18. Radially located, equally spaced apart vertical stiffeners 23 extend between the continuous cylindrical elements 21 and 22. Horizontal ring 24 is located upwardly from the lower ends of cylindrical members 21 and 22 and is joined to those cylindrical elements. Load bearing insulation block 25 is joined to the lower surface of ring 24 by means of suitable fasteners which are not shown but which may be of a conventional type. Mounted on the outside surface of cylindrical member 21 is a plurality of load bearing insulating circular section blocks 26 which are positioned as shown in FIG. 3. These insulating blocks are placed in abutting end-to-end contact. Similarly, circular section load bearing insulating block segments 27 are placed in end-to-end abutting contact on the outer surface of cylindrical member 22. Any suitable fastening means may be used to join the insulating blocks 26 and 27 to the cylindrical members 21 and 22.

The trough member 30 as shown in FIGS. 2 and 3 has a vertical cylindrical member 31 which is mounted on the top of support base 15 and it is reinforced by a series of gussets 32. Circular segment adjusting plates 33 are mounted on the outer surface of cylindrical member 31 with a small space between the adjoining ends. A series of vertical circular segment plates 34 is mounted in end-to-end circular arrangement, or with a space between them, around the outer circumference of the ring member 20. The vertical plates 34 are joined to support base 15 and are reinforced by gussets 35. A series of circular segment vertical adjusting plates 36 is mounted on the inner surface of vertical plates 34. Similarly, segmented adjusting plate 37 is mounted beneath insulating block 25.

Chocking compound, not illustrated, will be added between plates 31 and 33, 34 and 36, and between base 15 and plate 37, after plates 33, 36 and 37 are adjusted into their final positions.

It is important in the embodiment illustrated by FIGS. 1 to 4 to have the radial distance between the inner faces of adjusting plates 33 and 36 equal to the radial distance between the outer surfaces of insulating blocks 26 and 27 plus the radial dimensional change which is caused by contraction of the tank when it is cooled such as from ambient temperature to a lower temperature, or the dimensional increase if the tank is warmed from ambient temperature to a higher temperature. In FIG. 2 the suppport system is shown as it would exist with a tank, designed for use at a temperature below ambient, at ambient temperature with the outer surface of insulating blocks 27 in contact with the surface of adjusting plate 36. When so positioned at ambient temperature a gap 40 of a circular configuration is present between the insulating blocks 26 and adjusting plate 33. Upon cooling of the tank 14 to a predetermined operating temperature the ring member 20 is caused to move radially inward until gap 40 is eliminated and insulating blocks 26 are positioned in surface contact with adjusting plates 33 and a corresponding gap dimensionally equal to gap 40 is created between insulating blocks 27 and the adjusting plates 36. The described tank support system thus securely holds the tank in position against movement which would otherwise be induced by ship motion since there is always a restraining action against any lateral movement of the tank whether it be at ambient temperature or at a substantially reduced temperature. The matching surfaces between block 26 and plate 33, and block 27 and plate 36 can also be sloped to prevent uplift of tank 14.

Obviously, if the tank of FIG. 2 is to operate at a temperature above ambient temperature the gap would initially be between blocks 27 and adjusting plates 36 at ambient temperature and this gap would be eliminated upon temperature increase and expansion of the tank.

Circumferential rotation of the tank about its vertical axis can be prevented by a series of spaced apart key-keyway units 41 radially and horizontally positioned. Each unit has a key 42 mounted on plate 37 and a keyway 43 in the insulation block 25 as shown in FIGS. 2 and 4.

Figure 5:
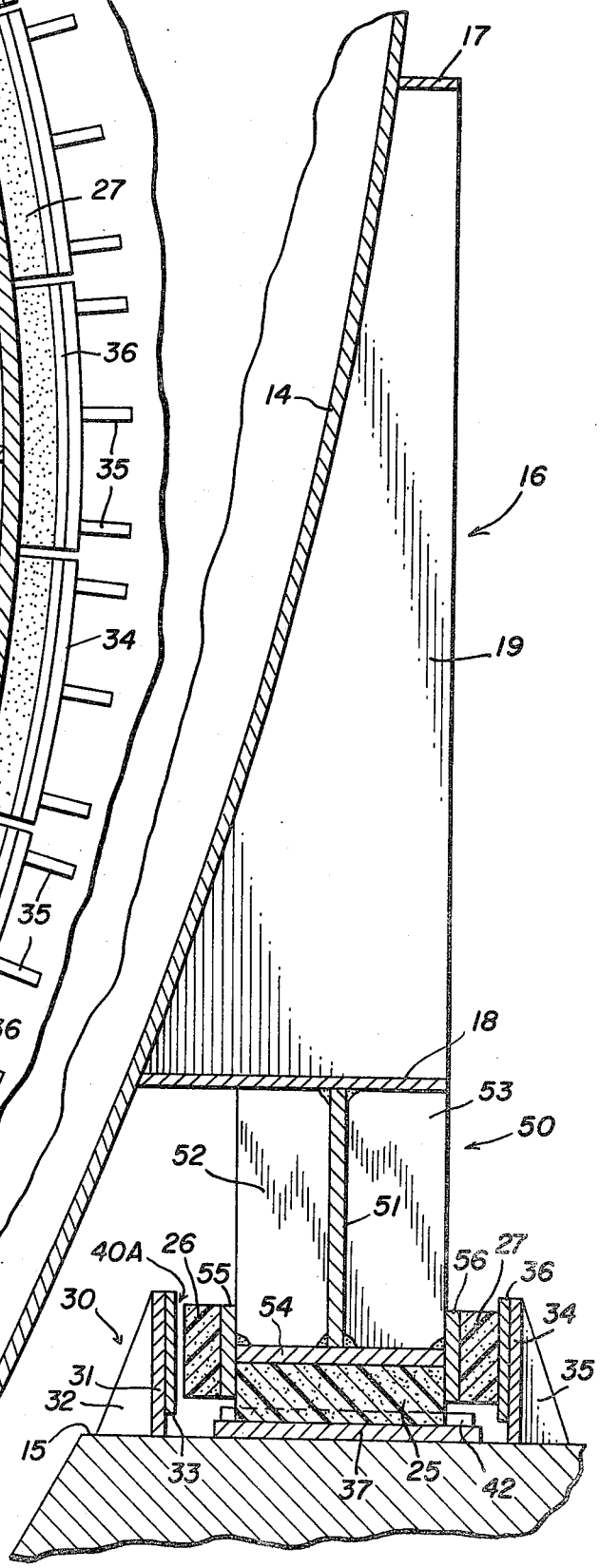
FIG. 5 is an alternative embodiment of the invention which may be used for supporting a tank.

FIG. 5 illustrates a second embodiment of the invention which in many respects is similar to the first embodiment shown in FIGS. 1 to 4. The only differences between the embodiments is in the ring member 50 shown in FIG. 5. The ring member 50 has a vertical continuous cylindrical member 51 which is reinforced radially on each side by equally spaced apart gussets 52 and 53. Horizontal circular plate 54, which is similar to plate 24, is mounted beneath cylindrical member 51 and gussets 52 and 53. Vertical continuous cylindrical plate 55 is mounted on the inner edge of circular plate 54 and insulating blocks 26 and joined to it by suitable fasteners. Similarly, vertical continuous cylindrical member 56 is joined to the outer edge of plate 54 and insulating blocks 27 are joined to it by suitable fastening means. In all other respects the structure of this embodiment is like that shown in FIGS. 1 to 4 and it operates in the same way with a gap 40A provided when the tank is at ambient temperature.

Figure 6:
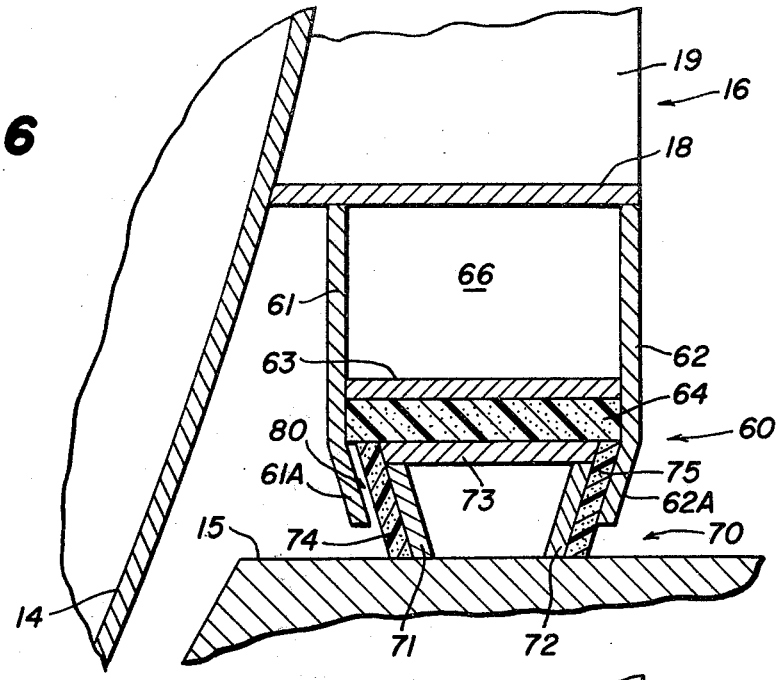
FIG. 6 is a vertical sectional view showing a third embodiment of a support system provided by the invention.

A third embodiment of the invention is illustrated by FIG. 6. In this embodiment the trough member 60 is joined to the tank support element 16 and the ring member 70 is joined to support base 15. The arrangement of these parts is thus the reverse of that shown in the two embodiments illustrated by FIGS. 1 to 5. The ring member and the trough member also have sloping or inclined sides adapted to mate with contraction and expansion of the tank. The trough member 60 has equally spaced apart continuous cylindrical members 61 and 62 with horizontal plate 63, and radially positioned spaced apart vertical reinforcing plates 66, spaced therebetween. The lower ends 61A and 62A of members 61 and 62 slope downwardly toward each other. The slope could start at any location on plates 61 and 62. Load bearing insulating block 64 is fastened to the lower surface of member 63. The ring member 70 includes a pair of equally spaced apart members 71 and 72 joined at their lower edges to support base 15 and which slope outwardly from each other as they extend upwardly. A plate 73 is supported by the top edges of members 71 and 72 and provides a bearing surface for insulating block 64. Load bearing insulating block 74 is mounted on the outer surface of member 71 and load bearing insulating block 75 is mounted on the outer surface of member 72. A gap 80 is provided between the insulating block 74 and the member 61A. This gap is equal to the radial expansion of tank 14 when it rises in temperature from a cryogenic temperature up to ambient temperature. Once the tank reaches ambient temperature the gap 80 is eliminated and member 61A is positioned in contact with the surface of insulating block 74 and a gap is then present between insulating block 75 and member 62A equal dimensionally to the gap 80. The embodiment of FIG. 6 provides protection against tank uplift if the hold floods, whether the tank is at ambient temperature or a cryogenic service temperature because of the sloped sides on the trough 60.

Figure 7:
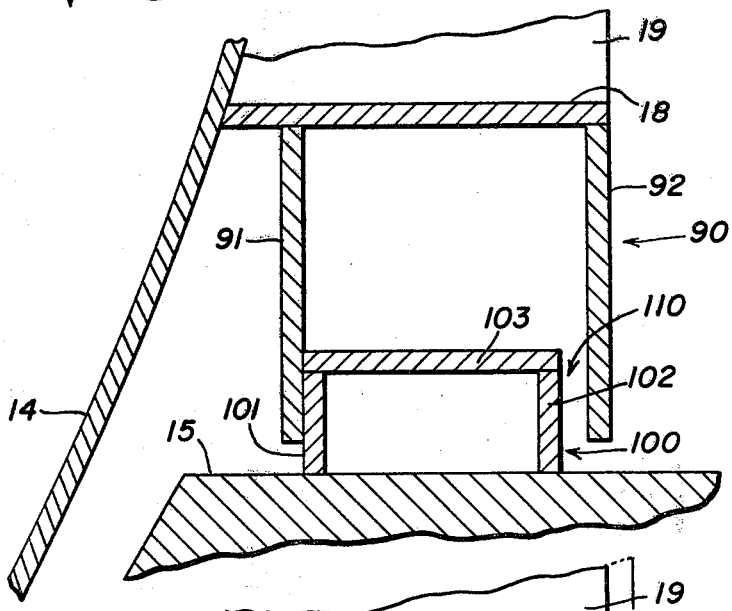
FIG. 7 is a vertical sectional view of a tank support system showing the relative positions of the tank support element and the support base before contraction of the tank.
Figure 8:
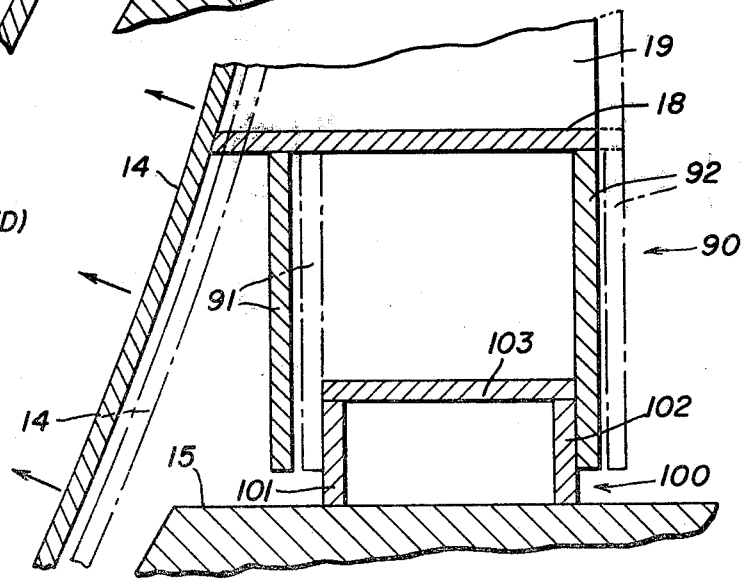
FIG. 8 shows the support system of FIG. 7 positioned after the tank has contracted through a substantial temperature reduction with the original position of the tank and support system shown in phantom.

FIGS. 7 and 8 are included to further illustrate the movement of the tank and part of the tank support system with temperature-induced contraction. As shown in these figures, trough member 90 is composed of spaced apart, vertical cylindrical members 91 and 92 which are joined at their upper ends to girder 18, thereby forming the trough. Ring member 100 includes a pair of vertical spaced apart cylindrical members 101 and 102 which support on their top ends horizontal circular plate 103, thereby completing the ring member. At ambient temperature a gap 110 (FIG. 7) exists between cylindrical member 92 of the trough member and the cylindrical member 102 of the ring member. Upon lowering the temperature, such as to a cryogenic temperature, the tank metal contracts and causes the cylindrical member 92 to be brought into contact with cylinrical member 102, thereby eliminating gap 110 and creating a gap of similar size between cylindrical member 101 and cylindrical member 91. As a result the described support system securely holds the tank in position against lateral movement whether the tank is at ambient temperature or at a substantially lower cryogenic temperature. It should be understood with respect to FIGS. 7 and 8 that the structures shown in those drawings are schematic since they do not include means to support the vertical load applied by the tank or the load bearing insulation needed to retard heat flow.

Figure 9:
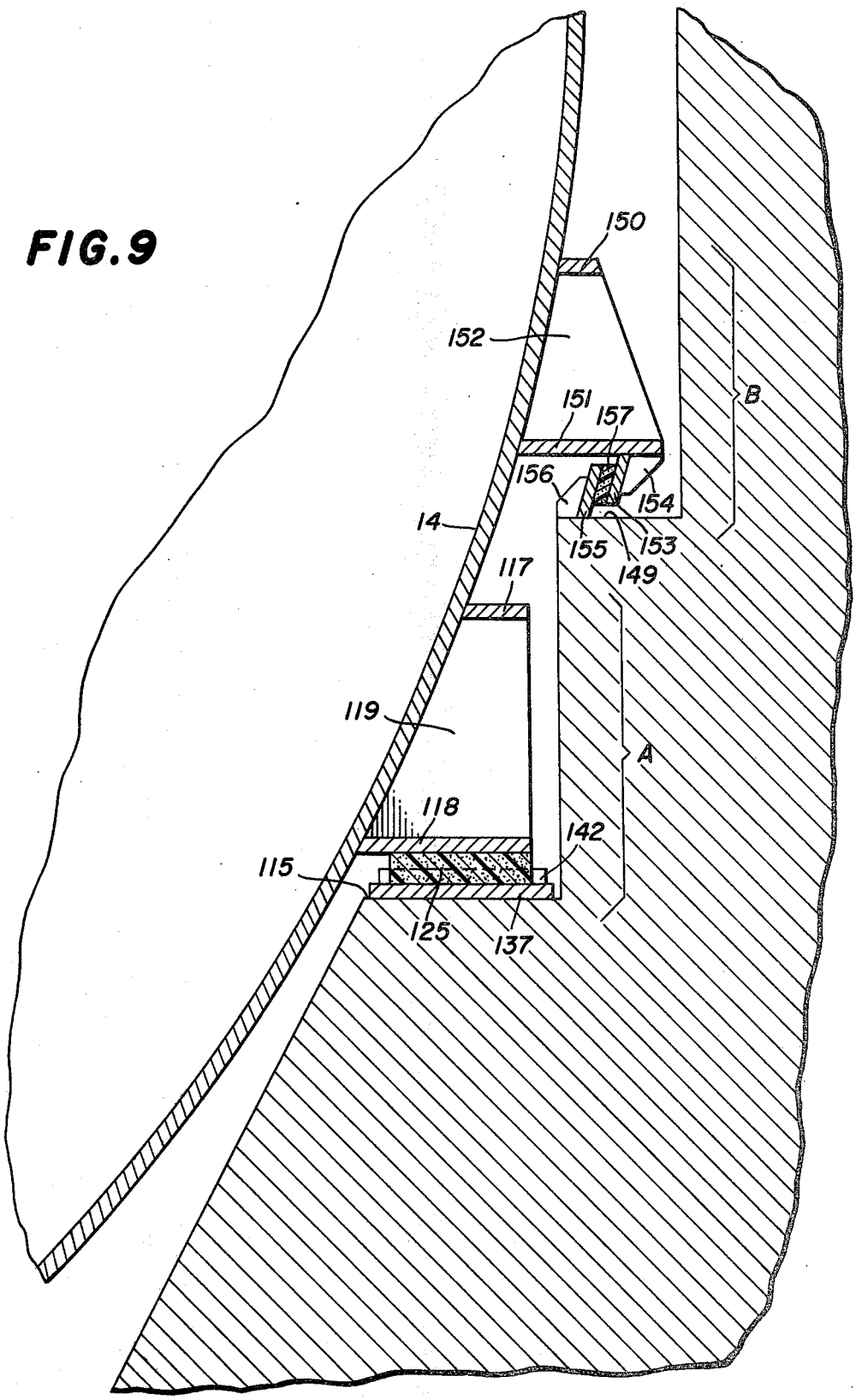
FIG. 9 is a partial vertical sectional view through a tank mounted in a ship using a support system in which the means for supporting vertical and lateral loads are separated.

FIG. 9 illustrates a further embodiment of the invention. In this embodiment the means for accepting or supporting tank vertical loads is separated from the means for restraining lateral loads applied by the tank. The means for transferring vertical loads from the tank 14 to the ship are shown at A in FIG. 9. This vertical load support system consists of a pair of horizontal girders 117 and 118 welded to tank 14 and reinforced by spaced apart vertical plates 119. Load bearing insulation 125 is joined to the bottom of girder 118. The insulation has a flat bottom circular surface which contacts the upper flat surface of plate 137 supported by ship hold ledge 115. Radially positioned keys 142 fit into keyways in the bottom of load bearing insulation 125 in the same way as the key-keyway units 41 shown in FIGS. 2 and 4.

The means for transferring lateral loads from the tank to the ship are shown at B in FIG. 9. Horizontal girders 150 and 151 are welded to tank 14 and are reinforced by vertical spaced apart plates 152. Extending downwardly from the bottom of girder 151 is inwardly sloped circular collar 153 which is reinforced by gussets 154. Mounted on ship ledge 149 is outwardly sloped circular ring 155 which is reinforced by spaced apart gussets 156. Load bearing insulation 157 is mounted on ring 155. The outer face of load bearing insulation 157 has a sloped face parallel to the adjacent face of collar 153 so that these surfaces shrink-fit into contact when the tank is cooled from ambient temperature down to a cryogenic temperature. At ambient temperature, however, the collar 153 is displaced outwardly from insulation 157. The empty tank at ambient temperature is, nevertheless, restrained against lateral movement by the keys 142 located radially around the tank as needed. The keys in addition restrain circumferential rotation of the tank about its vertical axis at cryogenic service temperature if slippage may occur between the insulation 157 and collar 153 when shrink-fitted together.

The sloped surfaces of insulation 157 and collar 153 shrink-fit together at a cryogenic service temperature and thus restrain the tank against uplift if the ship hold should be flooded.

Although the drawings illustrate the invention as applied to support of a spherical tank it should be understood that the invention is useful in the support of other tanks with circular horizontal cross-sections, such as cylindrical tanks and tanks eliptical in vertical cross-section.

The foregoing detailed description has been given for clearness of understanding only, and no unnecessary limitations should be understood therefrom, as modifications will be obvious to those skilled in the art.

What is claimed is:

1. In combination:

a tank with a circular horizontal cross-section, which expands and contracts in service, a tank support element on the tank and above the tank bottom extending horizontally around the tank and having a flat horizontal surface, a support base on which the tank support element flat horizontal surface rests in radial slidable contact, a horizontal collar member having a face circular in section, a horizontal ring member having a face circular in section, wherein one of the collar member and the ring member is joined to the tank and the other one of the collar member and the ring member is joined to the support base, and the collar member face is located around the ring face, and restraining means which prevents lateral movement of the tank when empty and at nonservice temperature.

2. A combination according to claim 1 in which at least one of the collar member face and the ring member face is insulated, and the faces are parallel to each other and matching for effecting surface-to-surface contact upon cooling of the tank, and at least one of the horizontal surface on the tank support element and the support base is insulated.

3. In combination:

a tank with a circular horizontal cross-section, which expands and contracts in service, a tank support element extending horizontally around the tank, a support base, a collar member having an upwardly directed face circular in section and a flat horizontal surface, a ring member having a flat horizontal surface and an upwardly directed face circular in section, the collar member is joined to one of the tank support element and the support base, the ring member is joined to the other one of the tank support element and the support base, and the collar member upwardly directed face is located around the ring member upwardly directed face with the collar horizontal surface in radial slidable contact with the ring horizontal surface, and restraining means which prevents lateral movement of the tank when empty and at ambient nonservice temperature.

4. A combination according to claim 3 in which at least one of the collar member upwardly directed face and the ring member upwardly directed face is insulated, the faces are parallel to each other and matching for effecting surface-to-surface contact upon cooling of the tank, and at least one of the collar horizontal surface and the ring member horizontal surface is insulated.

5. In combination:

a tank with a circular horizontal cross-section, which expands and contracts in service, a tank support element extending horizontally around the tank, a support base, a ring member having a pair of equally spaced apart faces circular in section and a flat horizontal surface, a trough member having a trough with a flat horizontal surface and a pair of equally spaced apart faces circular in section, the ring member is joined to one of the tank support element and the support base, the trough member is joined to the other one of the tank support element and the support base, and the ring member is located in the trough member with the ring horizontal surface in radial slidable contact with the trough horizontal surface, and restraining means which prevents lateral movement of the tank when empty and at ambient nonservice temperature.

6. A combination according to claim 5 in which at about 10° to 35° C. one of the trough member faces is in contact with one of the ring member faces, and at a substantially different temperature these faces move out of contact with each other and the other trough member face contacts the other ring member face.

7. A combination according to claim 5 in which at least one of the opposite tank support element and support base faces constitutes thermal insulation.

8. In combination:

a tank with a circular horizontal cross-section, which expands and contracts in service, a tank support element joined horizontally to the tank, the tank support element having a pair of equally spaced apart vertical cylindrical faces with one face radially inward from the other face and positioned uniformly from the tank and having a flat horizontal slidable bottom surface, a support base adapted to receive the tank support element, the support base having a flat horizontal upper surface in contact with the tank support element flat horizontal bottom surface, the support base having a pair of equally spaced apart vertical cylindrical faces constituting a radially inward face and a radially outward face, and one of the pair of faces of the support base and the pair of faces of the tank support element being between one of the pair of faces of the tank support element and the pair of faces of the support base, and so positioned to have each tank support element face opposite a support base face.

9. A combination according to claim 8 in which at about 10° to 35° C. one of the support base faces is in contact with one of the tank support element faces, and at a substantially different temperature these faces move out of contact with each other and the other support base face contacts the other tank support element face.

10. A combination according to claim 8 in which at least one of the tank support element flat bottom surface and the support base flat upper surface constitutes thermal insulation.

11. A combination according to claim 8 in which the tank support element includes two spaced apart vertical substantially cylindrical walls arranged radial to and around an adjacent wall portion of the tank, one support element vertical and circular face is on the concave side of the inner cylindrical wall and the other support element vertical and circular face is on the convex side of the outer cylindrical wall, and the pair of faces of the tank support element are between the pair of faces of the support base.

12. A combination according to claim 11 in which the support base includes two spaced apart vertical substantially cylindrical walls arranged radial to the tank, and one support base vertical and circular face is on the convex side of the inner cylindrical wall and the other support base vertical and circular face is on the concave side of the outer cylindrical wall.

13. A combination according to claim 12 in which at least one of the opposite tank support element and support base faces constitutes thermal insulation.

14. A combination according to claim 13 in which at least one of the tank support element flat bottom surface and the support base flat upper surface constitutes thermal insulation.

15. A combination according to claim 11 in which at least one of the opposite tank support element and support base faces constitutes thermal insulation.

16. A combination according to claim 15 in which at least one of the tank support element flat bottom surface and the support base flat upper surface constitutes thermal insulation.

17. In combination:

a tank with a circular horizontal cross-section, which expands and contracts in service, a tank support element on the tank and above the tank bottom extending horizontally around the tank and having a flat horizontal surface, a support base on which the tank support element flat horizontal surface rests in radial slidable contact, a horizontal collar member having a sloped face circular in section, a horizontal ring member having a sloped face circular in section, one of the collar member and the ring member is joined to the tank and the other one of the collar member and the ring member is joined to the support base, and the collar member face is located around the ring face, and restraining means which prevents lateral movement of the tank when empty and at nonservice temperature.

18. A combination according to claim 17 in which at least one of the collar member face and the ring member face is insulated, and the faces are parallel to each other and matching for effecting surface-to-surface contact upon cooling of the tank, and at least one of the horizontal surface on the tank support element and the horizontal surface on the support base is insulated.

19. In combination:

a tank with a circular horizontal cross-section, which expands and contracts in service, a tank support element extending horizontally around the tank, a support base, a collar member having an upwardly directed face circular in section and a flat horizontal surface, a ring member having a flat horizontal surface and an upwardly directed face circular in section, the collar member is joined to one of the tank support element and the support base, the ring member is joined to the other of the tank support element and the support base, and the collar member upwardly directed face is located around the ring member upwardly directed face with the collar horizontal surface in radial slidable contact with the ring horizontal surface, and restraining means which prevents lateral movement of the tank when empty and at ambient nonservice temperature.

20. A combination according to claim 19 in which at least one of the collar member upwardly directed circular face and the ring member upwardly directed face is insulated, the faces are parallel to each other and matching for effecting surface-to-surface contact upon cooling of the tank, and at least one of the collar horizontal surface and the ring member horizontal surface, is insulated.

21. In combination:

a tank with a circular horizontal cross-section, which expands and contracts in service, a tank support element extending horizontally around the tank, a support base, a ring member having a pair of equally spaced apart sloped faces circular in section, and a flat horizontal surface, a trough member having a trough with a flat horizontal surface and a pair of equally spaced apart sloped faces circular in section, the ring member is joined to one of the tank support element and the support base, the trough member is joined to the other of the tank support element and the support base, and the ring member is located in the trough member with the ring horizontal surface in radial slidable contact with the trough horizontal surface, and restraining means which prevents lateral movement of the tank when empty and at ambient nonservice temperature.

22. A combination according to claim 21 in which at about 10° to 35° C. one of the trough member faces is in contact with one of the ring member faces, and at a substantially different temperature these faces move out of contact with each other and the other trough member face contacts the other ring member face.

23. In combination:

a tank with a circular horizontal cross-section, which expands and contracts in service, a tank support element joined horizontally to the tank, the tank support element having a pair of equally spaced apart vertical faces circular in section with one face radially inward from the other face and positioned uniformly from the tank and having a flat horizontal slidable bottom surface, a support base adapted to receive the tank support element, the support base having a flat horizontal upper surface in contact with the tank support element flat horizontal bottom surface, the support base having a pair of equally spaced apart vertical faces circular in section constituting a radially inward face and a radially outward face, and one of the pair of faces of the support base and the pair of faces of the tank support element being between the other pair of faces and so positioned to have each tank support element face opposite a support base face.

24. A combination according to claim 23 in which at about 10° to 35° C. one of the support base faces is close to or in contact with one of the tank support element faces, and at a substantially different temperature these faces move out of contact with each other and the other support base face contacts the other tank support element face.

* * * * *

UNITED STATES PATENT AND TRADEMARK OFFICE

CERTIFICATE OF CORRECTION

PATENT NO. : 4,128,070

DATED : December 5, 1978

INVENTOR(S) : Fahim E. Shadid & Paul R. Johnson

It is certified that error appears in the above-identified patent and that said Letters Patent are hereby corrected as shown below:

Column 1, line 26, "tank" should be --tanks--; line 35, "throuh" should be --through--; column 3, line 7, after "tank" insert --which--; claim 11, lines 56 and 58, delete "and circular" in both occurrences and in place thereof insert--cylindrical--; claim 12, lines 65 and 67, delete "and circular" in both occurrences and in place thereof insert --cylindrical--

Signed and Sealed this

*Twenty-sixth* Day of *February 1980*

[SEAL]

*Attest:*

SIDNEY A. DIAMOND

*Attesting Officer*

*Commissioner of Patents and Trademarks*